US006390085B1

(12) United States Patent
Stinson

(10) Patent No.: US 6,390,085 B1
(45) Date of Patent: May 21, 2002

(54) ARROW QUIVER FOR RETRACTABLE-BLADE BROADHEADS

(76) Inventor: Robert E. Stinson, 7292 Peaceful Valley Rd., Acme, MI (US) 49610

( * ) Notice: Subject to any disclaimer, the term of this patent is extended or adjusted under 35 U.S.C. 154(b) by 0 days.

(21) Appl. No.: 09/253,429

(22) Filed: Feb. 19, 1999

Related U.S. Application Data

(60) Provisional application No. 60/075,516, filed on Feb. 19, 1998.

(51) Int. Cl.[7] ..... F41B 5/06

(52) U.S. Cl. ..... 124/86; 124/25.7; 224/916

(58) Field of Search ..... 124/1, 23.1, 25.5, 124/25.7, 86; 224/916

(56) References Cited

U.S. PATENT DOCUMENTS

| | | | | | |
|---|---|---|---|---|---|
| 2,908,432 | A | | 10/1959 | Kent | 224/242 |
| 2,954,764 | A | | 10/1960 | Stinson | 124/25.7 |
| 2,980,305 | A | | 4/1961 | Reese | 124/25.7 |
| 3,116,730 | A | * | 1/1964 | Tingley | 124/24.1 |
| 3,337,099 | A | | 8/1967 | Rose | 224/242 |
| 3,561,651 | A | * | 2/1971 | Ramsey | 124/25.5 X |
| 3,716,174 | A | | 2/1973 | Ehlert | 124/88 |
| 3,777,734 | A | | 12/1973 | Rose | 124/25.5 |
| 4,020,984 | A | | 5/1977 | Morris | 124/88 |
| 4,156,496 | A | | 5/1979 | Stinson | 124/25.7 |
| 4,607,606 | A | * | 8/1986 | Schaar | 224/916 X |
| 4,995,372 | A | * | 2/1991 | Topel | 124/25.5 |
| D331,319 | S | * | 12/1992 | Stinson | |
| 5,452,703 | A | * | 9/1995 | Bateman | 124/25.7 X |
| 5,775,313 | A | * | 7/1998 | Bresette et al. | 124/86 |

* cited by examiner

*Primary Examiner*—John A. Ricci
(74) *Attorney, Agent, or Firm*—Price, Heneveld, Cooper, DeWit & Litton

(57) ABSTRACT

An arrow quiver for retractable-blade and other broadheads includes an arrowhead-receiving housing comprising a cup-shaped member, and a liner inside said housing having a transverse wall portion defining a series of adjacent openings for receiving and retaining a broadhead having a tip, a mid section adjacent the tip, and a plurality of blades adjacent the mid section. The openings have a centrally located recess to receive the tip of the broadhead and a plurality of slot arms extending outwardly from the recess to receive the blades of the broadhead. The recess is configured to contact the tip of the broadhead when the broadhead is inserted into the housing and thereby prevent the blades of the broadhead from undesired contact with the interior of the housing. In one alternative, the liner inside said cup-shaped member is provided with at least one raised boss having an opening for receiving and engaging the tip of the broadhead, and the liner may include guides for guiding the tip of the broadheads into and out of the openings. A first arrow-shaft receiver is provided for guiding the broadhead into and out of the housing as well as holding the shaft of the arrow carrying the broadhead, and a second arrow shaft-receiving retainer is provided for holding the shaft of each arrow at a point spaced from the first shaft-retainer.

28 Claims, 3 Drawing Sheets

ARROW QUIVER FOR RETRACTABLE-BLADE BROADHEADS

CROSS-REFERENCE TO RELATED APPLICATION

This application claims priority under 35 U.S.C. §119(e) on U.S. Provisional Application No. 60/075,169 entitled ARROW QUIVER FOR RETRACTABLE-BLADE BROAD HEADS, filed Feb. 19, 1998, by Robert E. Stinson., the entire disclosure of which is incorporated herein by reference.

BACKGROUND OF THE INVENTION

This invention relates to bow-mounted arrow quivers and, more particularly, to the arrowhead-receiving housings (i.e., broadhead shields) and arrow-retaining elements used in these quivers.

An arrowhead-receiving shield or housing typically comprises a molded cup-like receptacle which includes an arrowhead or tip retainer at its base or closed end. Often, this is simply a thick layer of polymeric foam into which the arrowheads may be partially embedded by pushing them into such placement A more refined such arrowhead retainer comprises a molded plastic wall or other such member which has a plurality of tip-receiving bore structures with radially-directed slot formations extending therefrom for receiving and retaining the arrowhead point and blades. One such device is shown in the present inventor's prior U.S. Pat. No. 4,156,496, which discloses a structure that is adapted to accept a variety of arrowheads, including not only arrowheads having a plain pointed tip but also a variety of commonly-available broadheads as well. However, the arrowhead retainer of the '496 patent, as well as those of all other commercially available arrowhead shields, is not adapted to accept the movable-blade "mechanical broadhead" arrows which have recently come into use, which have pivotally mounted blades that are normally closed and lie along the shaft of the broadhead but spring open upon impact to provide radially extending cutting edges. Presently, there are no known bow quivers that are designed to accept these more complex arrowheads, and certainly none which will accept the wide variety of different kinds of broadheads being produced, including both standard and "mechanical broadheads."

One problem associated with the arrowhead-receiving broadhead shields or housings of currently available quivers is that they have no internal structure for receiving and retaining mechanical broadheads, or for doing so in a way which will not jamb or release their movable blades. Mechanical broadheads have too little tip exposure when the blades are in the closed position to penetrate into the foam or plastic liners or tip retainers of known broadhead shields in a manner which will immobilize the broadheads from movement. Consequently, mechanical broadheads are likely to come loose from such tip retainers and rattle within the shield. This becomes an especially significant problem with mechanical broadheads because, if they are loose within the broadhead shield, the mechanical broadheads may be inadvertently released and spring outward. When the blades of mechanical broadheads are in their closed position, some of them are held closed by friction and others by small rubber bands or O-rings. In operation, these broadheads spring open under extremely light pressure and practically anything contacting them will cause them to open prematurely. When used with currently available quivers, the mechanical broadheads are likely to contact some part of the interior of the arrowhead shield, such as the plastic liner wall, foam bedding, or other arrows, etc. If this occurs, and, as a result, the blades of the mechanical broadheads inadvertently open, they will noisily clatter around inside the shield, are likely to become damaged, and in any event cannot thereafter be properly shot until carefully closed once again.

To avoid these problems, the field of quivers and arrowhead shields is in need of an improved design which can accommodate various types of broadhead arrows, mechanical or otherwise, and which can hold the arrows securely when stored, thus minimizing the chance that the arrowheads will come in contact with other arrows or with the interior of the housing.

SUMMARY OF THE INVENTION

The arrowhead-receiving housing or "broadhead shield" and associated arrow retaining means of the instant invention is designed to accommodate any of a multitude of currently available broadhead arrows. Unlike the analogous parts of currently known quivers, the components of the instant invention securely retain all types of arrows, including those having to mechanical broadheads, and substantially eliminate the chance that arrows with mechanical broadheads disposed therein will inadvertently activate as a result of random jostling, etc. Further, the several embodiments of the invention are capable of storing a plurality of different kinds of broadhead-tipped arrows, which may be of varying shape and size.

To achieve these and other aspects of the invention, the quiver of a first embodiment includes a broadhead shield or housing that comprises a molded cup-shaped portion open at one end and a molded liner secured therein for receiving and retaining the arrowheads. The molded liner has a perimeter wall and a base, wherein the base has at least one receptacle for receiving a broadhead. The receptacles are molded integrally with the base section and have a central bore for receiving the shaft of a broadhead, as well as a plurality of slot arms for receiving the blades of a broadhead, including, for instance, the closed blades of a mechanical broadhead. The receptacles of this first embodiment are designed to accommodate broadheads having either two or three blades, and are positioned so as to maximize the number of arrows that may be stored in the housing.

A second embodiment of the instant invention includes an arrowhead-receiving shield designed to accommodate a variety of different known broadhead-type arrows. This shield includes a molded cup-shaped housing which is open at one end for receiving arrowheads, and has a molded liner attached therein which has openings or recesses for receiving and stabilizing the tips of arrows to be stored. Preferably, the molded liner has a generally flat bottom wall that is generally parallel to the open end of the housing and includes at least one boss with a socket-like recess therein for receiving and engaging the tip of a broadhead, which may be either of a conventional fixed-blade or "mechanical" moving-blade type. Further, the housing preferably contains a railing-like shaft retainer that is secured to the liner and defines a series of notches to grip the shafts of the arrows held thereby so the arrow will be stabilized within the housing regardless of the amount of jostling to which it is subjected. The retainer grips the shaft of the arrow a short distance behind the broadhead blades, so that the width, length, number of blades, and the shape of the broadhead are irrelevant. The retainer further acts to guide the arrowhead tips into (and out of) the liner recesses, thus further minimizing the chance that a mechanical broadhead will be inadvertently activated.

Both the first and second embodiments of the invention referred to above contemplate use of the noted arrowhead shields or housings and their associated arrow-retaining and positioning components in an overall quiver structure which includes an elongated main frame or support member which is mountable on and extends along the handle-riser part of an archery bow to mount the quiver itself thereupon, in a generally known manner, such frame member having an arrow-shaft retainer or holder secured thereto at a point spaced from the arrowhead shield. The invention is not limited to such an overall structure, however, and may also be implemented by using a pair of separate bow-mounted components, without an interconnecting main frame member, as shown in some of the accompanying figures of the drawings.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
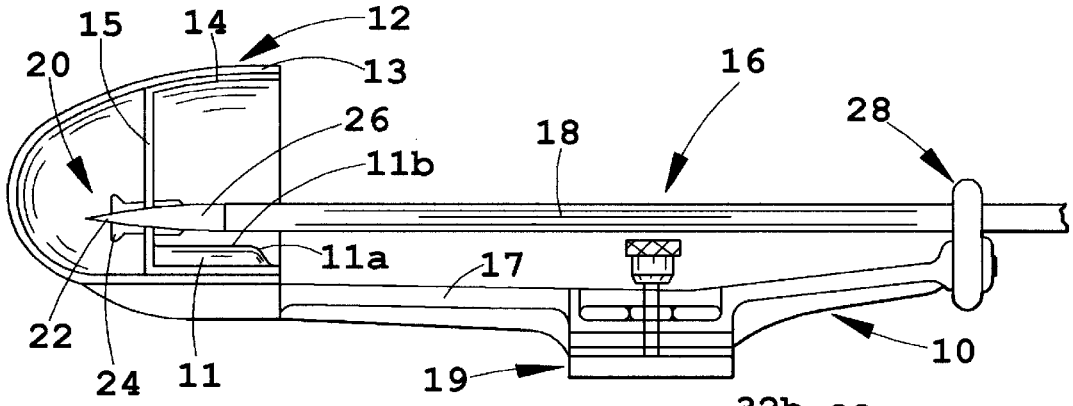
FIG. 1 is a side elevational view of a bow-mounted quiver which includes a first embodiment of the arrowhead-receiving housing, shown in central section.

Referring to FIG. 1, a quiver 10 is shown which in an overall sense is like that of the aforementioned '496 patent but which incorporates the improvements of the present invention. As illustrated, quiver 10 has an arrowhead-receiving broadhead shield or housing 12 comprising an outer cup-like portion 13 and an inner broadhead shield liner 14 attached to cup-like portion 13, as for example by use of an adhesive. Quiver 10 also includes an elongated body or main frame portion 17 to which the housing 12 is secured, an arrow shaft holder 28 at the end of body 17 opposite housing 12, for securely retaining a plurality of arrows 16 stored in quiver 10, and an attachment device 19 such as that shown in the aforementioned '496 patent as well as in U.S. Pat. No. 5,265,585, also issued to the present inventor, by which the quiver 10 is attached to the bow in a secure but releasable manner. Both the '496 patent and the '585 patent are incorporated herein by reference.

Figure 2:
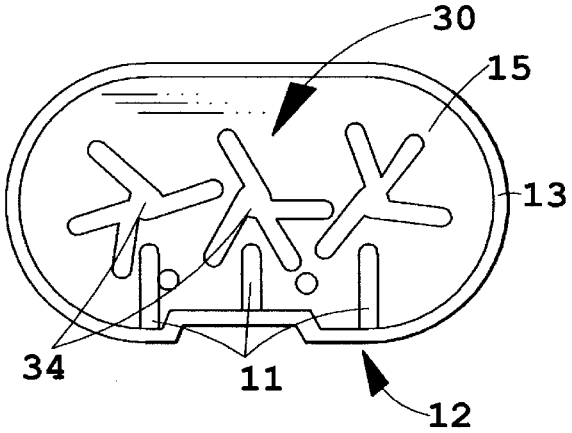
FIG. 2 is an end view showing the arrowhead-receiving housing of FIG. 1.
Figure 3:
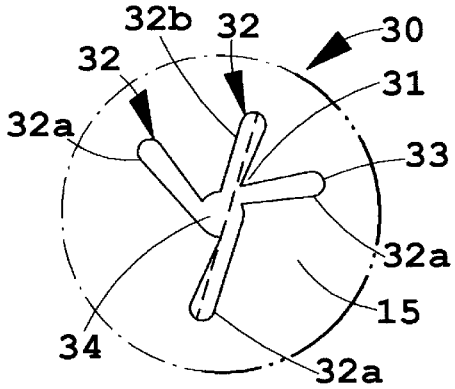
FIG. 3 is a fragmentary enlarged end view showing one of the receptacles for receiving the tip of an arrowhead in the embodiment of FIGS. 1 and 2.

Turning to FIGS. 1, 2, and 3, broadhead shield liner 14 of arrowhead-receiving housing 12 contains a base wall 15 having a series of arrowhead receptacles 30 formed therein. Receptacles 30, shown in a grouping or arrangement in FIG. 2 and more particularly in FIG. 3, have a somewhat enlarged and (preferably) rounded, centrally disposed tip-receiving bore 34 and a plurality (in the preferred embodiment four) of slot arms 32 extending outwardly from bore 34 to accommodate the blades 24 of either a conventional broadhead or a mechanical broadhead 20 having its blades closed upon its shaft. The slot arms 32 are defined by a proximal end 31 and a distal end 33. To store arrows, the user inserts the head of an arrow 16 into arrowhead-receiving housing 12 and guides the arrowhead 20 into one of the arrowhead receptacles 30. More particularly, tip 22 of a mechanical broadhead 20 enters the tip-receiving bore 34 of receptacle 30, and its folded or closed blades 24 enter slot arms 32. When arrow 16 is fully inserted, arrowhead receptacle 30, and specifically its center passage 34, frictionally receives the forward end portion of shaft 26, which is generally conical, and the folded blades 24 of mechanical broadhead 20 are loosely disposed in slots 32. In this position, tip 22 of arrowhead 20 is prevented from moving forward any further to contact the bottom of cup-like portion 13. To further stabilize arrow 16, its shaft 18 is then snapped into the lower or rear shaft holder 28. When stored in this fashion, arrows 16 are securely retained and not loose to rattle around within housing 12; therefore, the chance that blades 24 will activate inadvertently is eliminated or greatly minimized.

Figure 4:
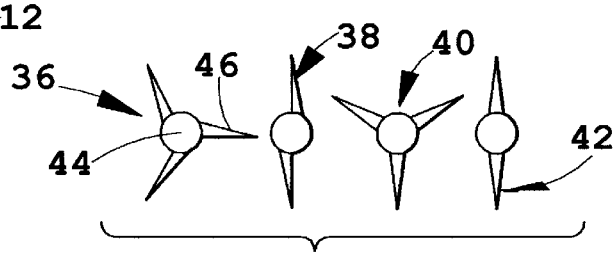
FIG. 4 is an illustrative end elevational view showing several different known broadhead blade arrangements.

With reference to FIGS. 3 and 4, arrowhead receptacles 30 are specially configured to receive and retain a wide variety of different broadhead arrowheads. For example, the arrowheads depicted in FIG. 4 represent the shaft and blade arrangement of most the different mechanical or conventional broadheads that are currently available. Arrowhead receptacle 30 has slot arms 32 arranged to accommodate both three-bladed broadheads 36, 40 and two-bladed broadheads 38, 42. Slot arms 32 of receptacles 30 are made sufficiently wide to minimize the chance that the blades of mechanical broadheads will contact shield liner 14, and are oriented at particular angles and locations relative to a centerline passing through bore 34 of receptacle 30, as illustrated, to thereby accommodate virtually any type of two or three-bladed broadhead.

More particularly, receptacles 30 are preferably strategically located and shaped, as illustrated in FIG. 3, so that slot arms 32 are narrower at their proximal end 31 than at their distal end 33, gradually widening as they proceed outwardly from bore 34. In addition, some of the slot arms (e.g., those designated 32*a*) are preferably offset laterally from a truly radial position with respect to bore 34, similar to the positioning of blades 46 in arrowhead 36 shown at the left in FIG. 4, while one or more of the other slot arms(s) (e.g., those designated 32*b*) are more nearly radial. This special configuration accommodates all of the broadhead blade configurations shown in FIG. 4, and in doing so tends to place opposite sides of oppositely extending blades in contact with the adjacent side of the corresponding slot arm at its base or proximal end 31, as shown by the heavy dashed line in FIG. 3. In this manner, a firm fit and reliable retention are obtained while looseness, free rotation, and resultant clacking noises are prevented. Once again, it is to be noted that receptacles 30 will receive various different mechanical broadhead configurations such as those designated 36, 38, 40, 42, having blades 46 that are either offset or centered relative to the longitudinal axis of the broadhead. For instance, the same two slot arms 32 of arrowhead receptacle 30 shown in FIG. 3 will receive broadhead 38, which has two offset blades, or broadhead 42, which has two centered blades, as depicted by the dashed line in FIG. 3.

A further feature of a preferred embodiment of the quiver 10 is the presence of a low rail-like guide wall 11 (FIGS. 1 and 2) disposed in substantial alignment with bore 34 of each of the arrowhead receptacles 30 and extending rearwardly of base wall 15 toward the open end of housing 12. Guide walls 11 preferably have a top edge 11*a* which is disposed just below the lower edge of arrowhead shaft 26, and also preferably include a smoothly curved lead-in edge 11*b*. As so configured, guide walls 11 greatly facilitate rapid and easy correct placement of arrowheads inside the broadhead shield 12, with tip 22 inserted into center portion 34 of the receptacles 30, since the shaft portion 26 may be rested atop the guide wall 11 and pushed along it until tip 22 enters aperture 34. This is especially true where the more prevalent three or four-bladed arrowheads are used, in which each of two adjacent blades may be placed on opposite sides of the guide wall 11 to provide a self-guiding arrangement Furthermore, the guide wall 11 will provide a support beneath the arrowhead shaft 26 between its blades 24 (whether they may be of the conventional fixed type or the foldable "mechanical" type). This will prevent the blades from inadvertently contacting the liner 13 during insertion or retraction of the arrowhead, or from allowing the arrowhead to bump against the side of the liner in the event the arrow somehow slips or is pulled out of its retained position, possibly damaging broadhead blades or tripping 1, (triggering) mechanical broadhead blades.

Figure 5:
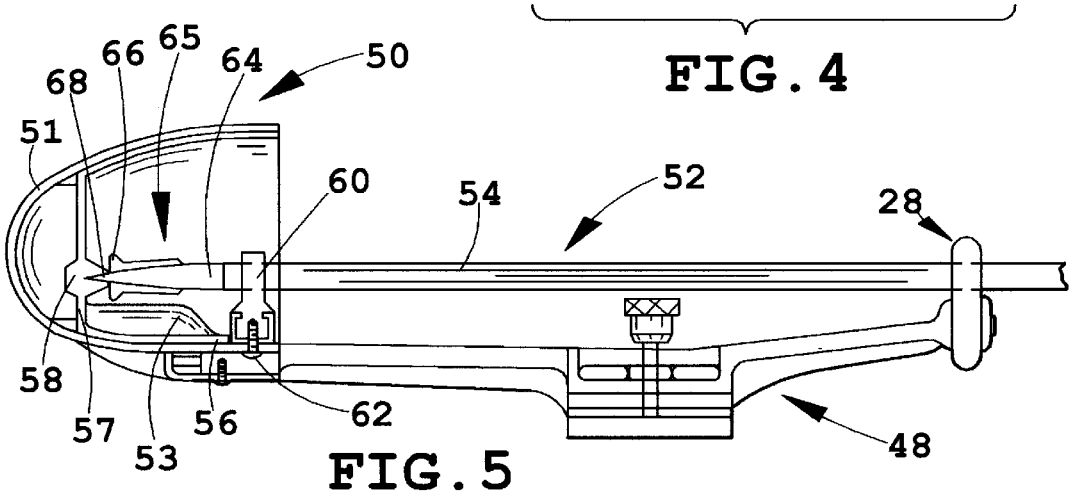
FIG. 5 is a cross-sectional, side elevational view similar to FIG. 1 but showing a second embodiment of the arrowhead-receiving housing.
Figure 6:
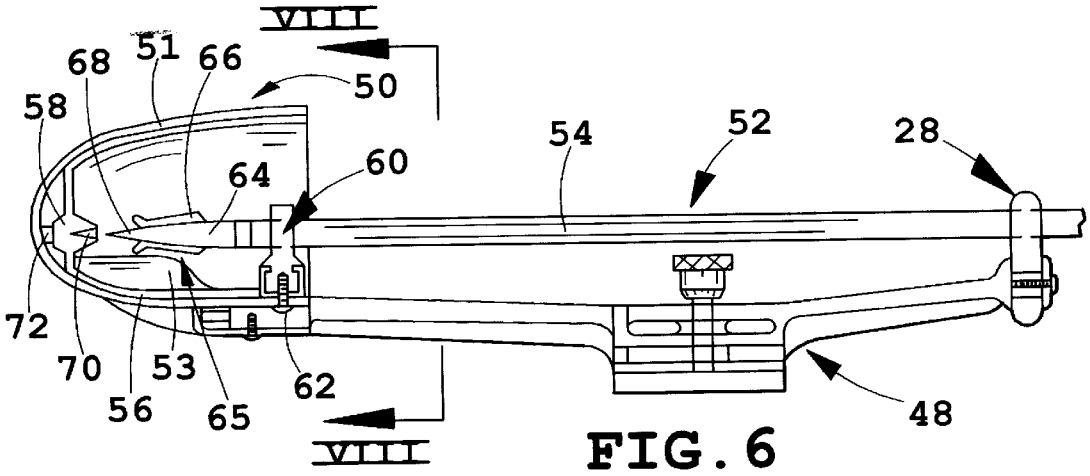
FIG. 6 is a cross-sectional, side elevational view of the embodiment shown in FIG. 5 showing an arrow which is partially inserted therein.
Figure 7:
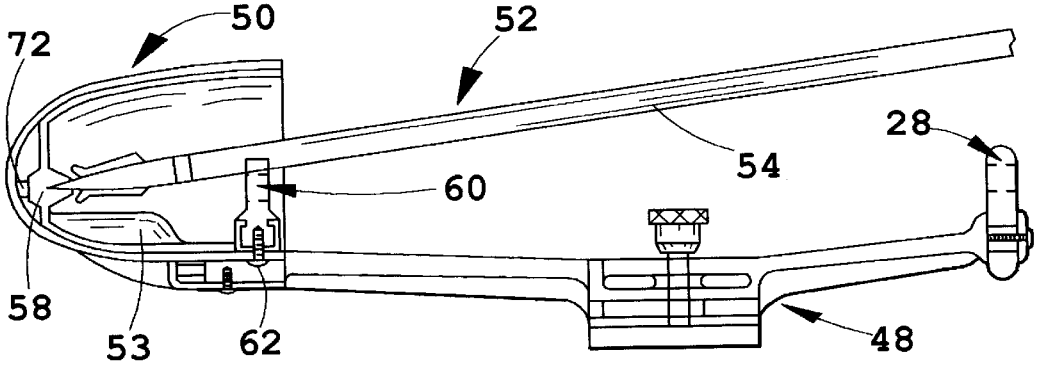
FIG. 7 is a cross-sectional, side elevational view of the second embodiment showing an arrow partially removed therefrom.

Turning to FIGS. 5, 6, and 7, a quiver 48 is shown having an arrowhead-receiving shield housing 50 of a second, and preferred, embodiment. This also includes a cup-shaped outer housing portion 51 and a broadhead shield liner 56 that is shaped to fit snugly inside and is attached to the interior wall of cup-shaped portion 51. Broad head shield liner 56 includes a base wall 57 that is disposed inside housing 50 at a distance from the open end of the latter. The base wall 57 contains a plurality of mutually spaced and laterally adjacent hub-like bosses 58 that define generally conical recesses 70 therein (FIG. 6), each of which will receive the conically tapered tip 68 of an arrowhead, such as mechanical broadhead 65. In addition, the interior of housing 50 contains a shaft-receiving retainer 60 that is secured inside broadhead shield liner 56, as by use of the illustrated fastening means, e.g., screws 62. Retainer 60 extends substantially parallel to the opening of housing 50 and has a series of spaced adjacent slots adapted to receive an arrow shaft 54 at a point spaced from the arrowhead, as illustrated. According to a preferred aspect of the invention, these slots operate to guide an arrowhead into place within liner 56 while also providing a means for securely holding the arrow shaft 54 in position at a point just behind broadhead 65, thus retaining arrows 52 firmly in place within housing 50. To further retain the arrows in place in quiver 48, a second shaft holder 28 is provided at the opposite end of body/frame member 17, for gripping the other end portion of shaft 54 of arrow 52.

Figure 8:
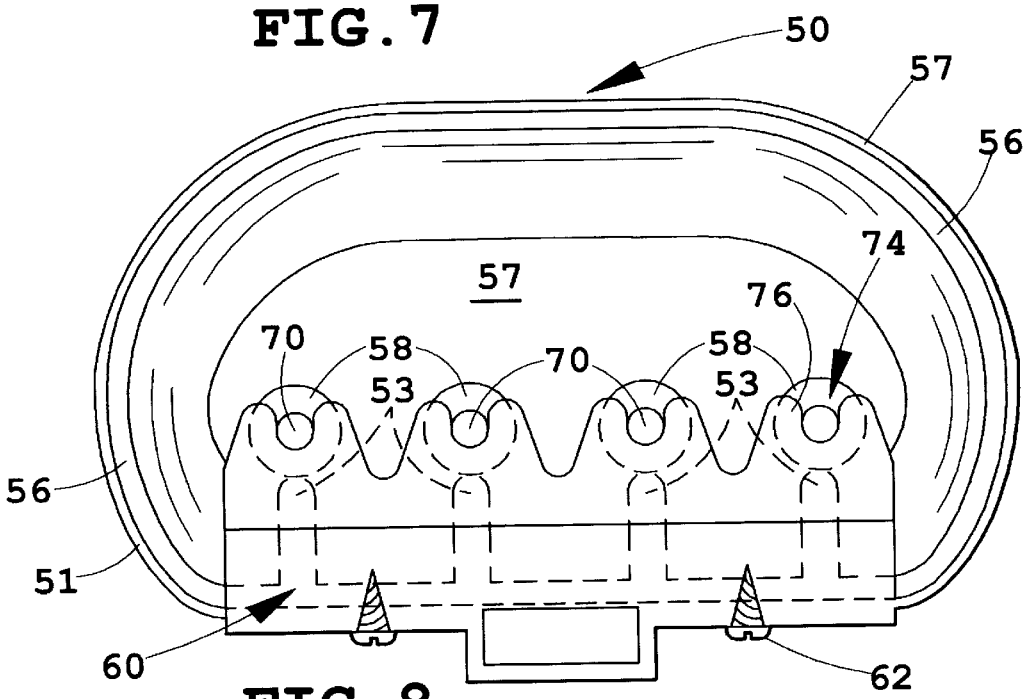
FIG. 8 is an enlarged end elevational view showing the shaft retainer of the second embodiment of the invention in association with the shield or housing in or near which it is mounted.

Broad head shield liner 56 of quiver embodiment 48 also preferably includes a series of guide walls 53 which are shaped and positioned much like the guide walls 11 of embodiment 12 described above, and which serve the same purpose. With reference to FIGS. 6, 7 and 8, arrows 52 may be mounted in quiver 48 by initially placing the upper portion of the arrow shaft 54 in one of the slots or notches 74 of retainer 60, and inserting the lower end of the arrow shaft 54, remote from broadhead 65, into a corresponding slot or notch of the other shaft holder/retainer 64. Notches 74 contain lip portions 76 that grip shaft 54 of arrow 52 to normally retain movement of arrow 52 either laterally or longitudinally. Both notches 74 and the corresponding notches of shaft holder 64 preferably do allow axial sliding movement of the arrows placed therein when the arrows are grasped and deliberately pushed, however, and will thus guide the arrowhead tips 68 into and out of engagement with the recesses 70 inside arrowhead-receiving housing 50 without allowing them to contact the housing. The guide walls 53 may be used to facilitate accurate placement of arrowheads in broadhead shield 50, since they may be used to guide a broadhead up to and into initial engagement with recesses 70 of bosses 58 prior to engagement of arrow shaft 54 with a notch 74 of retainer 60. That is, the underside of shaft 54 may be slid along the top of a wall 53, or along a notch 74, using these structures as a guide to readily achieve proper placement of the arrowhead.

As an arrow 52 is thus inserted into position inside housing 50, the tip 68 of its arrowhead 65 is guided into place within the recess or opening 70 of the aligned boss 58 inside broadhead shield liner 56. To insure that each mechanical broadhead 65 placed in housing 50 is not inadvertently activated, tip receptacle/recess 70 extends sufficiently deep in boss 58 that tip 68 of mechanical broadhead 65 is reliably held in place but not deep enough to allow the forward-most edges of the folded broadhead blades 66 to touch the front side of bosses 58. To achieve this result, the conical angle of the bosses 58 relative to the center axis of recess 70 is at least slightly less than the angle of the forward-most surfaces of the closed broadhead blades 66 relative to their center axis (note FIGS. 6 and 7). As a result, the entrance of recess 70 contacts the sides of projecting tip 68 and seats it securely while positioning the folded broadhead blades 66 away from and out of contact with the outside of the bosses 58. Further, a thickened positioning section 72 of liner 56 is located between the front inside surface of cup-like portion 51 of housing 50 and the rear or base of each boss 58 to prevent movement of boss 58 in that direction and maintain its position. As shown in FIG. 8, in the preferred embodiment, shield/housing 50 may retain four mechanical broadhead arrows 52, there being four adjacent notches 74 in retainers 60 and 64, and a like number of bosses 58 with recesses 70. It is foreseen that the principles as described above may be utilized to construct an arrow quiver designed to accommodate a greater or lesser number of arrows.

As shown in FIG. 7, to withdraw an arrow from shield/housing. 50, the user first disengages the lower portion of shaft 54 from shaft holder 28 and tilts arrow 52 upward to disengage shaft 54 from lip portions 76 of notches 74 of retainer 60. The bosses 58 flex to act as a movable pivot point, thereby enabling arrow shaft 54 to be levered out of retainer 60, bosses 58 acting as a fulcrum. After doing so, the user may simply withdraw arrow 52 directly out of the broadhead shield or housing 50 along the same axis of tilt. Because the outside of the bosses 58 is angled and spaced from the folded broadhead blades 66, the user will not inadvertently activate mechanical broadhead 65 and release its blades when withdrawing arrow 52 from quiver 48. As a result, whether arrow 52 are being stored, inserted, or withdrawn, the mechanical broadhead 65 is not likely to be inadvertently activated.

Figure 9:
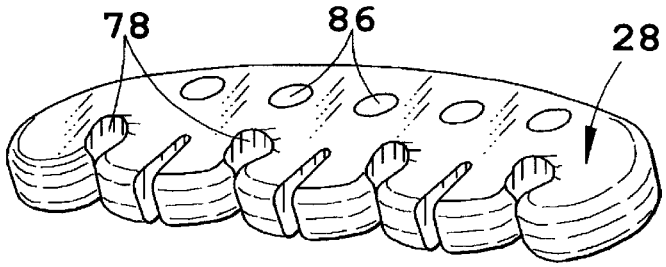
FIGS. 9, 10, and 11 are perspective, plan and sectional elevational views, respectively, illustrating a preferred arrow shaft-holder or retainer for mounting at the lower end of the quiver.
Figure 10:
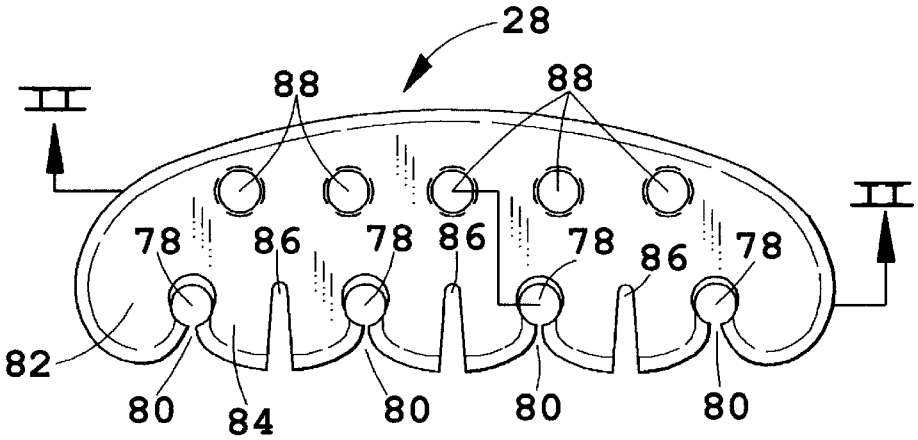
Figure 11:
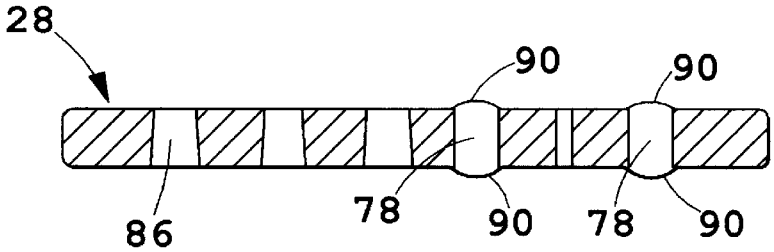

A preferred embodiment of the arrow holder, or arrow shaft holder, 28 is illustrated in further detail in FIGS. 9, 10, and 11. As already indicated, this component is preferably a one-piece element made from resilient, rubber-like material which is readily deformable to permit convenient insertion and withdrawal of arrow shafts into appropriately-sized transverse passages 78 by pushing the shafts through the smoothly rounded, convergent channels 80, which resiliently open sufficiently to allow the arrow shaft to pass through by merely pushing the arrow in the appropriate direction. This resilient flexing of the rounded protuberances (e.g., 82, 84) defining the channels 80 is substantially augmented by the illustrated slots 86, which facilitate the required deflection of each interior protuberance 84 the extent necessary to allow for convenient insertion and/or retraction of the arrow shafts into or out of the retainer passages 78. As illustrated, the slots 86 preferably extend to a point substantially aligned with the rear or innermost edge of the retainer slots 78, which configuration has been found to facilitate and enable the requisite easy flexing movement of these protuberances. A convenient and preferred mounting structure for the arrow retainers 28 is provided by the series of transverse apertures 88 illustrated, which receive mounting studs and permit passage of mechanical fasteners in a manner generally shown in FIG. 5 and further disclosed in Applicant's prior U.S. Pat. No. 4,156,496. Preferably, each of the arrow shaft retainer passages 78 is formed with a rounded integral cowl or collar 90, which may conveniently be made during the injection molding process by which the arrow holder 28 itself is made.

Figure 12:
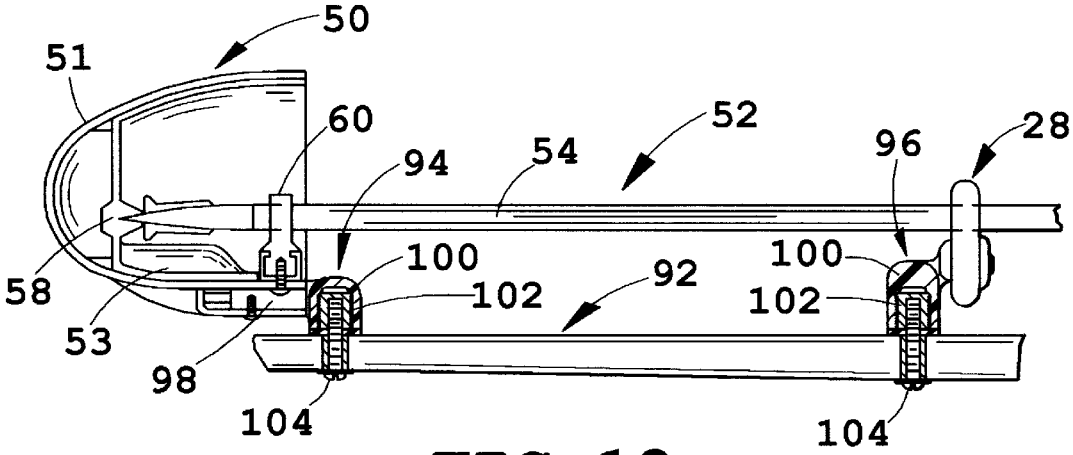
FIG. 12 is a side elevational view similar to FIG. 1 but showing an embodiment in which the arrow-receiving components mount directly upon the archery bow and the customary quiver main frame member is omitted.

FIG. 12 illustrates a further embodiment or adaptation of the quiver device 50 of FIGS. 5, 6, and 7 (which could as well be the quiver embodiment 12 of FIG. 1) in a form adapted for directed mounting on the archery bow 92 (which in most cases will be on the handle riser portion of the bow), preferably by means of mounting brackets or members 94, 96, whereby the elongated frame or body 17 and mounting bracket or device 19 shown in the previous figures is omitted. As will be apparent, FIG. 12 includes the same forward and rearward components 50, 28 shown in the embodiment of FIGS. 5, 6, and 7, which are thus left unnumbered in FIG. 12, but the body or frame 17, which normally connects and supports portions 28 and 50, is omitted and these portions are instead directly mounted on the bow (handle riser) 92. In this arrangement, the upper or forward bracket 94 includes a projecting tongue extremity 98 which essentially replicates the forwardmost part of the body/frame 17 of the other embodiments and connects to the cup-like shield or housing 51 in the same manner; however, mounting member 94 further comprises a right-angled offset knuckle or boss 100 having an internal threaded collet 102 which receives a mounting bolt or screw 104 that passes through appropriately located apertures in the bow handle riser 92. Similarly, the lower mounting bracket 96 also includes a knuckle or boss 100 with a threaded internal collet 102, into which a similar mounting bolt 104 is received to thereby mount the entire quiver apparatus directly on the bow.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. In combination, an arrow having a "mechanical" broadhead and a housing/shield for receiving said mechanical broadhead and portions of said arrow, comprising:

a shield having a generally cup-shaped portion with an open end;

a liner disposed within the cup-shaped portion, the liner having a perimeter wall and a base, the base having at least one receptacle for receiving portions of said mechanical broadhead;

said mechanical broadhead having a tapered tip and a plurality of blades disposed rearwardly of said tip which are movable to an open and a closed position, said tip being located forward of said blades when they are in their closed position;

said liner receptacle having portions whose size and shape are directly comparable to those of at least the tip portions of said closed mechanical broadhead located forwardly of the blades thereof in their closed position) such that said tip portions are seatably receivable within said receptacle portions to position the closed blades of the mechanical broadhead out of contact with said receptacle and shield, thereby preventing unintended triggering of the closed blades to their open position.

2. A broadhead-receiving housing/shield for an arrow quiver, comprising:

a generally cup-shaped portion with an open end;

a liner disposed within the cup-shaped portion, the liner having a perimeter wall and a base, the base having at least one receptacle having portions whose size and shape are directly complementary to at least portions of a closed mechanical broadhead, whereby such mechanical broadhead portions are interfittably receivable within said receptacle portions in a directly complementary manner;

said receptacle having a central bore and a plurality of slot anus, said slot arms arranged for receiving at least portions of the blades of a closed mechanical broadhead.

3. The broadhead-receiving housing/shield for a quiver as set forth in claim 2, wherein the slot arms of at least one receptacle are arranged to receive at least portions of the blades of a broadhead having either centerset blades or offset blades.

4. The broadhead-receiving housing/shield for a quiver as set forth in claim 3, wherein the slot arms of at least one receptacle extend laterally from the central bore at varying angular displacements from one another such that different broadheads having different numbers and arrangements of blades are receivable in the same receptacle.

5. The broadhead-receiving housing/shield for a quiver as set forth in claim 4, wherein the slot arms of at least one receptacle extend laterally from the central bore at varying angular displacements from one another such that broadheads having either two or three blades are receivable in the same receptacle.

6. The broadhead-receiving housing/shield for a quiver as set forth in claim 2, wherein the slot arms of at least one receptacle have a greater width at their outer portions than at their inner portions, whereby the blades of broadheads of differing configurations may be received within the slot arms of the same receptacle.

7. The broadhead-receiving housing/shield for a quiver as set forth in claim 6, wherein the slot arms of at least one receptacle are configured and spaced about the central bore so as to promote contact between at least a portion of the receptacle and a portion of the broadhead.

8. The broadhead-receiving housing/shield for a quiver as set forth in claim 2, including a guide positioned to guide the insertion of a broadhead into said at least one receptacle in a manner such that said at least portions of a closed mechanical broadhead enter and are received into said receptacle portions.

9. The broadhead-receiving housing/shield for a quiver as set forth in claim 8, wherein the guide comprises a projecting wall structure disposed generally transverse to said portions of a broadhead which is guided thereby.

10. The broadhead-receiving housing/shield for a quiver as set forth in claim 2, wherein the cup-shaped portion includes an array of guides positioned to facilitate placement of different such broadheads in predetermined locations within He receptacle, and wherein said guides comprise projecting wall portions extending generally transverse to said broadhead.

11. The broadhead-receiving housing/shield for a quiver as set forth in claim 10, wherein said wall portions are each disposed substantially orthogonal to the central bore of one of said recess.

12. A broadhead-tipped arrow and a housing/shield for receiving the tip of said broadhead, comprising:

a shield defining an enclosure having at least one open end and a support member disposed inside said enclosure, said support member having at least one receptacle;

a broadhead-tipped arrow having a forward end, a mid section located rearward of the forward end, and a plurality of blades located rearward of said mid section behind at least portions of said forward end;

said receptacle including at least one recess, said recess of said receptacle being sized and shaped to conformably receive only selected portions of the forward end and mid section of said forward end of said broadhead by direct abutting contact therewith and thereby preclude further insertion of said broadhead forward end into said receptacle, whereby said broadhead blades are located and maintained out of contact with said support member.

13. A broadhead-receiving housing/shield for a quiver, comprising:

an enclosure having at least one open end;

a support member disposed inside said enclosure, said support member having at least one receptacle for receiving selected portions of a broadhead having a tip located at its most forward end, a mid section rearward of the tip, and a plurality of blades located rearward of said tip and mid section behind at least portions of said tip, said receptacle including at least one recess to receive and particularly position only certain selected portions of said broadhead, said recess of said receptable being sized and shaped to conformably receive only selected portions of the tip and mid section of a broadhead received into said recess by direct abutting contact therewith to thereby preclude further insertion of said broadhead into said recess and thereby maintain the broadhead blades out of contact with said support member;

said enclosure provided with a guide to facilitate predetermined positioning of a broadhead within said receptacle as it is inserted herein.

14. The broadhead-receiving housing/shield for a quiver as set forth in claim 13, wherein said guide comprises a wall structure.

15. The broadhead-receiving housing/shield for a quiver as set forth in claim 14, wherein said wall structure has portions disposed in substantial alignment with said recess.

16. A housing for a quiver that retains broadhead-type arrows, comprising:

an enclosure having peripheral walls and an opening at one end for receiving a broadhead arrowhead;

a transverse member disposed inside said enclosure at a location spaced from said opening, said member including at least one boss having an opening for receiving and engaging the tip of a broadhead; and a first arrow shaft-receiving retainer extending generally parallel to and located generally adjacent said end opening of said enclosure, for receiving and positioning the shaft of an arrow carrying said broadhead when the tip of said broadhead is disposed in the opening in said boss.

17. A broadhead-receiving housing for a quiver according to claim 16, wherein said arrow shaft-receiving retainer is located inside said enclosure.

18. A broadhead-receiving housing for a quiver according to claim 16, wherein said transverse member includes a plurality of bosses disposed in mutually spaced positions.

19. A broadhead-receiving housing for a quiver according to claim 18, wherein said bosses comprise a resiliently deformable material.

20. A broadhead-receiving housing for a quiver according to claim 18, wherein said transverse member comprises flexible portions and said bosses are pivotable by flexing such flexible member.

21. A broadhead-receiving housing for a quiver according to claim 16, wherein the opening in said at least one broadhead-receiving boss is sufficiently shallow to keep the forwardmost edges of a closed mechanical broadhead blade out of contact with the outside of the boss.

22. A broadhead-receiving housing for a quiver according to claim 16, wherein the outside of said at least one boss is tapered to prevent the forward-most edges of closed mechanical broadhead blades from contacting the outside of the boss when the tip of such broadhead is disposed in said boss.

23. A broadhead-receiving housing for a quiver according to claim 16, and a second arrow shaft-receiving retainer extending generally parallel to the first arrow shaft-receiving retainer and having openings for receiving the shaft of an arrow.

24. A broadhead-receiving housing for a quiver according to claim 23, wherein the second arrow shaft-receiving retainer is spaced from the first along the length of an arrow retained thereby, to grip the shaft of the arrow at a location distant from the broadhead of such arrow.

25. A broadhead-receiving housing for a quiver according to claim 23, wherein said second arrow shaft-receiving retainer comprises a resiliently deformable portion having a primary slot extending into at least some of said openings from an adjacent edge of said retainer to permit passage of an arrow shaft from said edge into one of said at least some openings, and further having a secondary slot disposed between a pair of said primary slots which are positioned generally adjacent one another, said secondary slot facilitating resilient deformation of said retainer portion between said generally adjacent pair of primary arrow-passage slots.

26. A broadhead-receiving housing for a quiver according to claim 25, wherein said secondary slots extend from said adjacent edge of said retainer to a point which is generally coextensive with the innermost edge of said openings.

27. A broadhead-receiving housing/shield for a quiver, comprising:

an enclosure having at least one open end;

a support member disposed inside said enclosure, said support member having at least one receptacle for receiving selected portions of a broadhead having a tip located at its most forward end, a mid section rearward of the tip, and a plurality of blades located rearward of said tip and mid section behind at least portions of said tip, said receptacle including at least one recess to receive and particularly position only certain selected portions of said broadhead, said recess of said receptacle being sized and shaped to conformably receive only selected portions of the tip and mid section of a broadhead, received into said recess by direct abutting contact therewith to thereby preclude further insertion of said broadhead into said recess and thereby maintain the broadhead blades out of contact with said support member;

said receptacle and said at least portions of said tip having a generally tapered surface configuration defining complementary shapes which interfit with one another in generally flush and contiguous mutual contact.

28. The broadhead-receiving housing for a quiver according to claim 27, wherein said complementary shapes are generally conical.

* * * * *